US007134526B2

(12) United States Patent
Bradley

(10) Patent No.: US 7,134,526 B2
(45) Date of Patent: Nov. 14, 2006

(54) DRIVEWAY SAFETY NET AND METHOD

(76) Inventor: Gayle M. Bradley, 5128 Co. Rd. 25, Marengo, OH (US) 43334

( * ) Notice: Subject to any disclaimer, the term of this patent is extended or adjusted under 35 U.S.C. 154(b) by 224 days.

(21) Appl. No.: 10/825,935

(22) Filed: Apr. 16, 2004

(65) Prior Publication Data

US 2005/0230187 A1 Oct. 20, 2005

(51) Int. Cl.
*A62B 1/22* (2006.01)
*A63B 69/38* (2006.01)

(52) U.S. Cl. ..... 182/138; 182/139; 473/460

(58) Field of Classification Search ..... 182/138, 182/137, 139; 160/368.1, 238, 354, 327; 256/24, 1, 73, 45, 12.5, 35, 13.1; 473/490, 473/459, 460, 462, 493, 494, 492, 491; D30/154; 135/118; 52/155, 156, 160, 166; 248/500, 248/507, 508, 156
See application file for complete search history.

(56) References Cited

U.S. PATENT DOCUMENTS

| | | | | | |
|---|---|---|---|---|---|
| 659,424 | A | * | 10/1900 | Valkenburgh | 256/55 |
| 1,153,380 | A | * | 9/1915 | Fussell | 52/155 |
| 1,402,561 | A | * | 1/1922 | Banks | 52/156 |
| 1,459,723 | A | * | 6/1923 | Eskell | 473/492 |
| 2,554,887 | A | * | 5/1951 | Tricarico | 248/156 |
| 2,812,945 | A | * | 11/1957 | Barreca | 473/492 |
| 3,960,367 | A | | 6/1976 | Rogers | |
| 4,086,735 | A | * | 5/1978 | Adams | 52/160 |
| 4,407,505 | A | * | 10/1983 | Kendziorski | 473/173 |
| 4,553,739 | A | | 11/1985 | Baines | |
| 4,842,284 | A | * | 6/1989 | Rushing et al. | 473/492 |
| 4,913,428 | A | * | 4/1990 | Nauman | 52/165 |
| 4,993,719 | A | * | 2/1991 | Hernandez | 473/492 |
| 5,009,542 | A | | 4/1991 | Hardin, Jr. et al. | |
| 5,106,101 | A | * | 4/1992 | McKay | 473/492 |
| 5,156,408 | A | * | 10/1992 | Hall | 473/492 |
| 5,180,143 | A | * | 1/1993 | Brower | 256/24 |
| 5,326,109 | A | * | 7/1994 | Robl | 473/492 |
| 5,394,927 | A | * | 3/1995 | Huebner | 160/327 |
| 5,407,178 | A | * | 4/1995 | Long | 473/492 |
| 5,473,839 | A | * | 12/1995 | Stidham | 248/156 |
| 5,653,308 | A | * | 8/1997 | White | 182/138 |
| 5,885,176 | A | * | 3/1999 | Wong et al. | 473/490 |
| 5,961,099 | A | * | 10/1999 | Thommen, Jr. | 256/12.5 |
| 6,685,155 | B1 | * | 2/2004 | Chen | 248/156 |

FOREIGN PATENT DOCUMENTS

| | | |
|---|---|---|
| DE | 245785 | 3/1966 |
| DK | 58908 | 8/1941 |

OTHER PUBLICATIONS

Leaps and Bounds Early Summer 2004 Catalog p. 5 (2004 USA), no month available.
http://www.cyberbabymall.com/kc25.html (copyright 1998), no month available.

* cited by examiner

*Primary Examiner*—Hugh B. Thompson, II
(74) *Attorney, Agent, or Firm*—Butzer & Chen Law, LLC

(57) ABSTRACT

A driveway safety net. The safety net includes two stakes and a net that attaches between the two stakes. When the two stakes are placed on both sides of a driveway and the net is attached between the two stakes, the net hinders balls and other toys from rolling past the net. In one embodiment, each stake includes at least two prongs that are pushed into the ground when placing the stake. Preferably, at least one prong of each stake is wider in one dimension than in another dimension so that the stake is more resistant to being pulled over in at least one direction than in at least one other direction. Each prong is curved in an arc across its wider dimension.

16 Claims, 4 Drawing Sheets

DRIVEWAY SAFETY NET AND METHOD

BACKGROUND OF THE INVENTION

1. Field of the Invention

This invention relates to a safety net for an end of a driveway that helps prevent balls, bicycles, tricycles, and other toys from rolling into a street.

2. Description of the Related Art

Toy-cluttered driveways are extremely common in suburbia. Many of these toys have wheels or are round so that they can roll down a driveway. This creates several hazards.

First, a child who sees his or her toy roll down a driveway into a street just might chase that toy into the street, with possibly tragic consequences.

Second, even if a child does not chase a toy, the toy itself might roll into and stop in the street. This creates a hazard for cars, bicycles, and other vehicles that use the street. In addition, if an accident is cause by the toy, the homeowner might be held liable.

One common solution to these problems is parking a car at the end of the driveway. The inventor, a United States Postal Service letter carrier, has seen cars parked in this way for this reason innumerable times.

However, using a car as a toy stop creates its own problems. First, a car at the end of a driveway is not very protected from the elements, vandals, and the like. Second, when larger toys such as bicycles or tricycles roll into a car, they might damage the car. Furthermore, a car will not block the entire width of a driveway, so toys might still roll into the street.

SUMMARY OF THE INVENTION

Accordingly, what is needed is a device that helps prevent balls, bicycles, tricycles, and other toys from rolling down a driveway into a street.

The invention addresses this need with a driveway safety net. The safety net includes two stakes and a net that attaches between the two stakes. When the two stakes are placed on both sides of a driveway and the net is attached between the two stakes, the net hinders balls and other toys from rolling past the net. As a result, a child is less likely to follow a ball or toy into the street, and the ball or toy is less likely to end up in the street where it could cause an accident.

In one embodiment, each stake includes at least two prongs that are pushed into the ground when placing the stake. Preferably, at least one prong of each stake is wider in one dimension than in another dimension so that the stake is more resistant to being pulled over in at least one direction than in at least one other direction. Each prong can be curved in an arc across its wider dimension.

Each stake preferably includes at least two attachment points for the net, and the attachment points are on a side of the stake toward which the stake is more resistant to being pulled over. In preferred embodiments, the attachment points can be snap hooks, hook material, or loop material. Other types of attachments can be used to attach the net to the stakes.

The net can be made from any suitably strong and durable material, for example plastic or canvas netting.

In one embodiment, a bottom of the net is no more than three inches above the ground when attached between the two stakes. Possible dimensions for the net are two feet high by sixteen to seventeen feet wide. This size of net would work with a two lane driveway. Other sizes of nets, for example for use with a one lane or three lane driveway, can be used.

The invention also encompasses methods of using a driveway safety net according to the invention.

This brief summary has been provided so that the nature of the invention may be understood quickly. A more complete understanding of the invention may be obtained by reference to the following description of the preferred embodiments thereof in connection with the attached drawings.

DESCRIPTION OF THE PREFERRED EMBODIMENT

Figure 1:
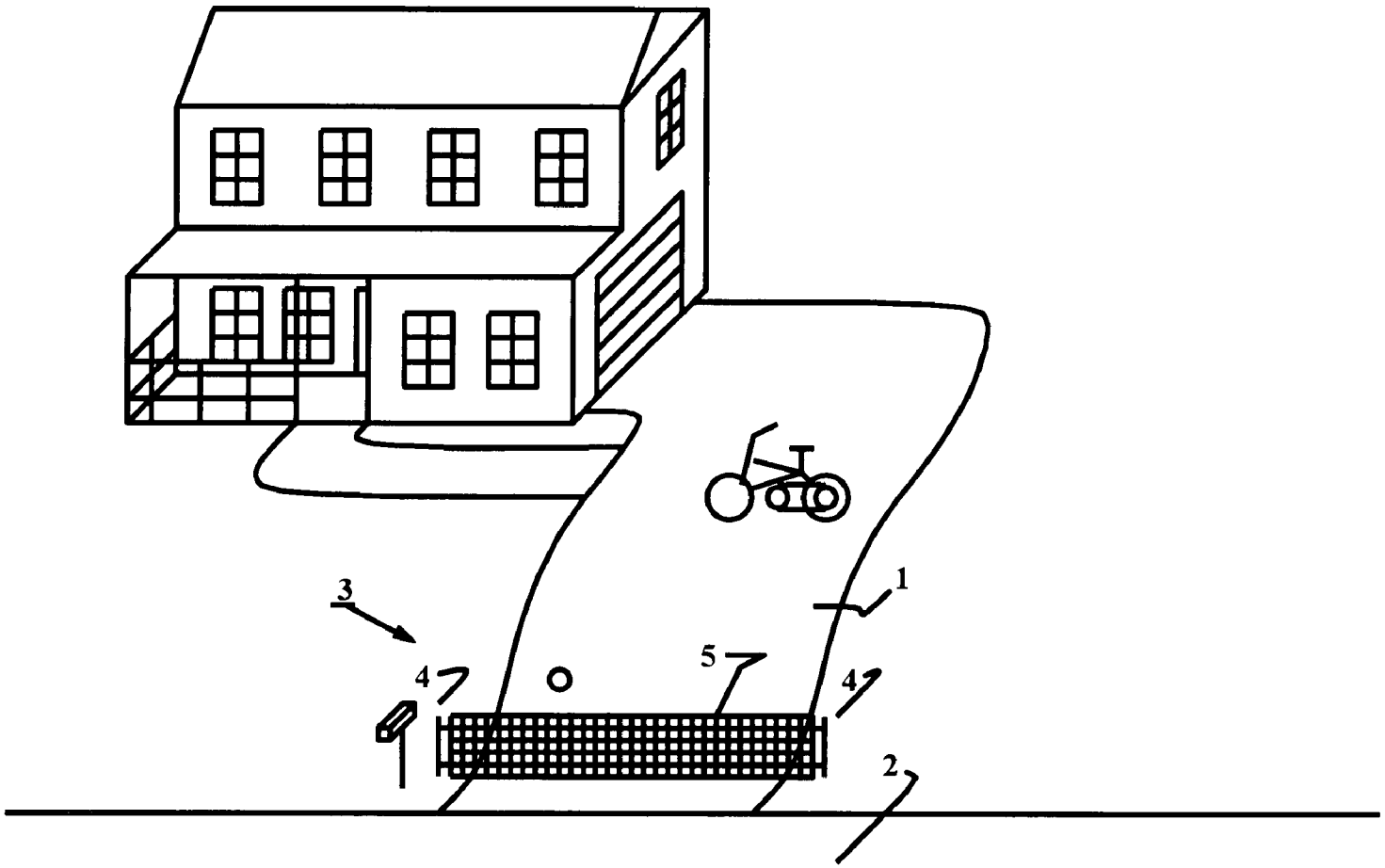
FIG. 1 shows one possible setting for a driveway safety net.

FIG. 1 shows one possible setting for a driveway safety net, namely a house with a ball and/or other toy(s) in its driveway. In order to hinder toys from rolling off driveway 1 into street 2, driveway safety net 3 has been put in place.

In a preferred embodiment, driveway safety net 3 includes two stakes 4 and net 5 that attaches between the two stakes. When the two stakes are placed on both sides of a driveway and the net is attached between the two stakes, the net hinders balls and other toys from rolling past the net. The term "hinder" is used here because some balls and other toys might still pass under, over, or through the net into the street. However, the driveway safety net should at least hinder most balls and other toys from rolling into the street.

The stakes preferably are made from any suitably strong, durable, and weather-resistant material. Examples include, but are not limited to, wood, heavy gauge plastic, aluminum, and stainless steel. Other materials can be used.

The stakes preferably include attachment points to which the net can be attached. Examples include, but are not limited to, snap hooks and hook-and-loop fasteners (e.g., Velcro® brand fasteners). Other types of attachments can be used. The ability to attach and to detach the net from the stakes can help facilitate set-up, take-down, and storage of the driveway safety net.

Alternatively, the net could be permanently or semi-permanently attached to the stakes. A net that is more permanently attached to the stakes might facilitate easier placement of the stakes at an appropriate distance from each other.

In FIG. 1, net 5 is shown with its bottom flush with the ground. Alternatively, some clearance could exist between the bottom of net 5 and the ground. This clearance should not be larger than the height of a small toy that might roll down driveway 1, for example a roller skate or baseball. In a preferred embodiment, the bottom of net 5 is no more than three inches above the ground when in place.

Net 5 also should be tall enough to stop larger toys such as a bicycle. In a preferred embodiment, the net is at least two feet high.

The net needs to be wide enough to span the entire driveway. A net that is sixteen and one half feet wide is appropriately sized for a two lane driveway. Smaller nets might be used for a one lane driveway, and larger nets might be used for a three lane or wider driveway.

Other dimensions of nets can be used without departing from the invention so long as they tend to hinder toys from rolling off a driveway into a street.

As shown in FIG. 1, net 5 preferably includes a plurality of holes or openings. Without these hole or openings, the driveway safety net might be more susceptible to environmental factors such as wind and rain. A net without holes or openings could be used if so desired.

The net preferably is made from any suitably strong, durable, and weather-resistant material. Examples include, but are not limited to, heavy gauge plastic and canvas. Other materials can be used.

Net 5 can be of any color. In one embodiment, net 5 is a bright eye-catching color so that a person driving a car would be more likely to notice the net before driving through it. Examples of possible colors include bright yellow, orange and red.

In another embodiment, net 5 is a softer color or a color that matches surrounding flora and landscaping. For example, net 5 could be a soft blue or green. This approach would lessen the visual impression of the safety net, which might be a concern for certain neighborhoods that have regulations concerning a property's appearance.

Figure 2:
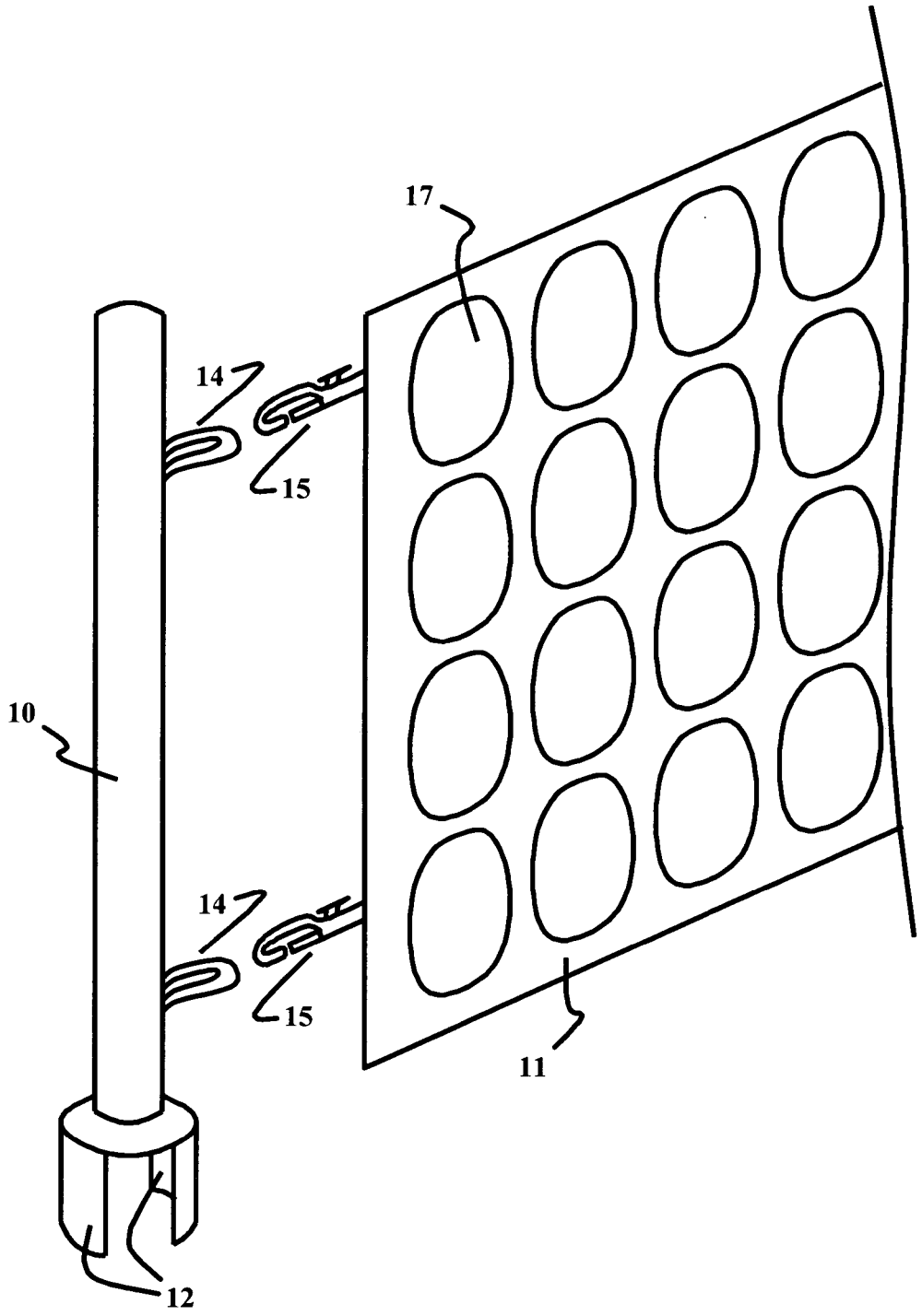
FIG. 2 shows details of an embodiment of a driveway safety net.

FIG. 2 shows details of an embodiment of a driveway safety net. Shown in FIG. 2 are stake 10 and net 11.

Stake 10 includes prongs 12 that are pushed into the ground when placing the stake. Prongs 12 are wider perpendicular to net 11. In addition, the prongs are curved in an arc along their wider dimension. These features help stake 10 to be more resistant to a pulling force from net 11. In other words, this design helps stake 10 to stay in the ground if net 11 is struck by a large toy, a child, wind, or the like. Other stake designs that help stakes to be more resistant to being pulled out of the ground can be used.

Stake 10 in FIG. 2 includes two attachment points in the form of snap hooks 14 for matching snaps 15 of net 11. Snap hooks 14 in FIG. 2 are on a side of stake 10 toward which the stake is more resistant to being pulled over.

Stake 10 also preferably includes a somewhat rounded top so as to help reduce injury that might occur from falling onto the stake. Alternatively, a flat top could facilitate use of a hammer or sledgehammer to pound the stake into hard ground.

Hole 17 in net 11 are typical of holes that might be in heavy gauge plastic netting, for example of a type commonly used at construction sites. Such netting is suitably tough, durable, and weather-resistant to be used for the driveway safety net.

Figure 3:
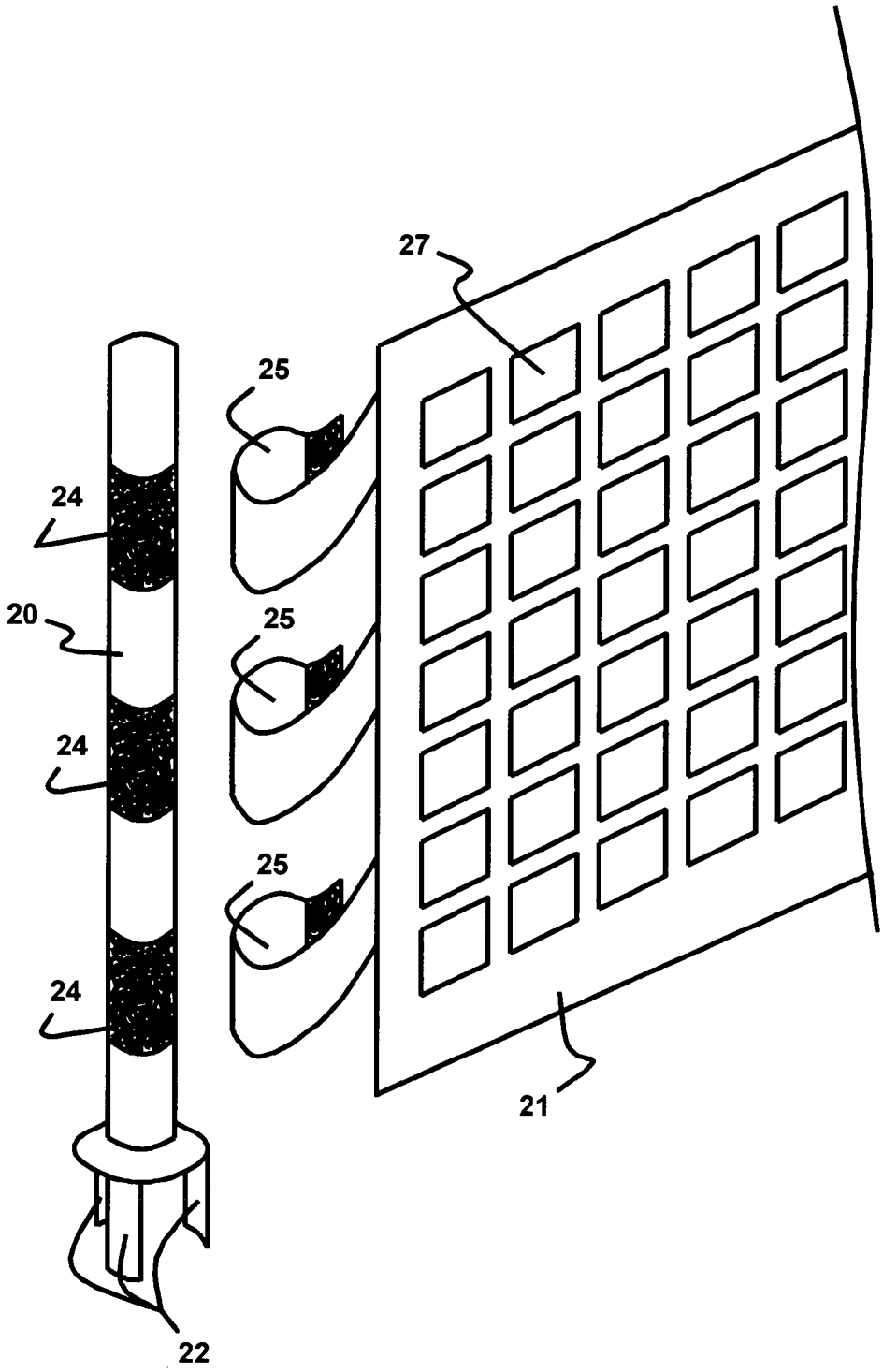
FIG. 3 shows variations for a driveway safety net.

FIG. 3 shows variations for a driveway safety net. Shown in FIG. 3 are stake 20 and net 21.

Stake 20 includes three prongs 22 that are pushed into the ground when placing the stake. With this design, even if stake 20 is twisted, the wider part of at least one of prongs 22 will be somewhat perpendicular to net 21. As a result, the orientation of stake 20 is less important with this design—the stake will be resistant to a pulling force from net 21 regardless of how it is oriented.

Stake 20 in FIG. 3 includes three attachment points in the form of hook material or loop material for hook-and-loop type fasteners 24. This material matches straps 25 that include the appropriate counterpart material. Thus, straps 25 would attach to fasteners 24.

Alternatively, straps 25 might simply attach to themselves around stake 20 (i.e., fasteners 24 might not be present), or the straps might attach to both themselves and to fasteners 24. Other designs are possible.

Hole 27 in net 21 are typical of holes that might be in canvas netting. Such netting is suitably tough, durable, and weather-resistant to be used for the driveway safety net. Other types of netting, including other types of materials with other types of holes, can be used.

The features shown in each of FIGS. 1, 2 and 3 can be used with features from any of the other figures. For example, two of the hook-and-loop type fasteners shown in FIG. 3 could be used with a two-pronged stake such as the one shown in FIG. 2. Other combinations are possible and are within the scope of the invention.

Figure 4:
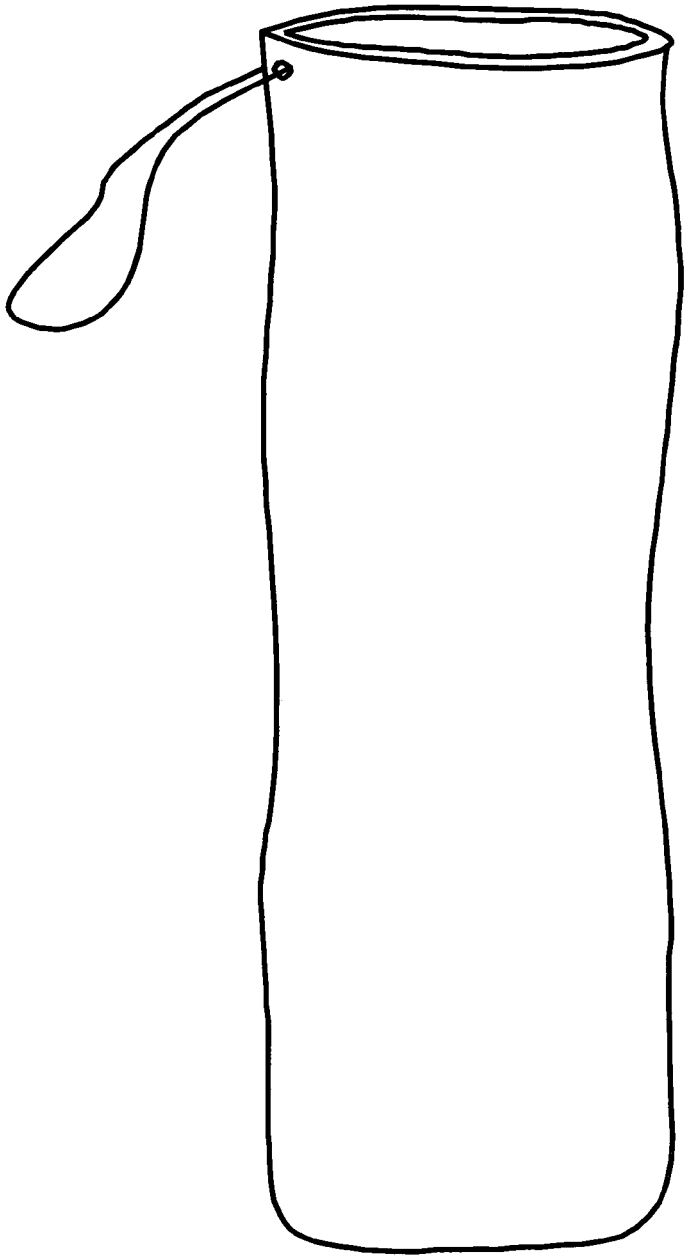
FIG. 4 shows a storage bag for a driveway safety net.

FIG. 4 shows a storage bag for a driveway safety net. The net preferably can be rolled up into a compact bundle for storage. The stakes can be removed (if removable) or left attached before the net is rolled up. Once rolled up, the entire driveway safety net can be placed in a bag such as the one shown in FIG. 4 for storage. Preferably, this bag also is made of a suitably tough and durable material such as heavy gauge plastic or canvas.

ALTERNATIVE EMBODIMENTS

The invention is in no way limited to the specifics of any particular preferred embodiment disclosed herein. Many variations are possible which remain within the content, scope and spirit of the invention, and these variations would become clear to those skilled in the art after perusal of this application.

What is claimed is:

1. A driveway safety net, comprising:

two stakes; and a net that attaches between the two stakes;

wherein when the two stakes are placed on both sides of a driveway and the net is attached between the two stakes, the net hinders balls and other toys from rolling past the net;

wherein each stake includes at least two prongs that are pushed into the ground when placing the stake;

wherein each prong of each stake is wider in one dimension than in another dimension so that the stake is more resistant to being pulled over in at least one direction than in at least one other direction; and wherein each prong is curved about a vertical axis of an arc across its wider dimension.

2. A driveway safety net as in claim 1, wherein each stake includes at least two attachment points for the net; and wherein the attachment points are on a side of the stake toward which the stake is more resistant to being pulled over.

3. A driveway safety net as in claim 1, wherein each stake includes at least two attachment points for the net; and wherein the attachment points are on a side of the stake toward which the stake is more resistant to being pulled over.

4. A driveway safety net as in claim 1, wherein each stake includes at least two attachment points for the net.

5. A driveway safety net as in claim 4, wherein the attachment points are snap hooks, hook material, or loop material.

6. A driveway safety net as in claim 1, wherein the net is made of plastic or canvas netting.

7. A driveway safety net as in claim 6, wherein when attached between the two stakes, a bottom of the net is no more than three inches above the ground.

8. A driveway safety net as in claim 6, wherein the net is two feet high by sixteen to seventeen feet wide.

9. A method of hindering balls and other toys from rolling off a driveway, comprising the steps of:

placing two stakes on both sides of a driveway;

attaching a net between the two stakes;

wherein each stake includes at least two prongs that are pushed into the ground when placing the stake;

wherein each prong of each stake is wider in one dimension than in another dimension so that the stake is more resistant to being pulled over in at least one direction than in at least one other direction; and wherein each prong is curved about a vertical axis of an arc across its wider dimension.

10. A method as in claim 9, wherein each stake includes at least two attachment points for the net; and wherein the attachment points are on a side of the stake toward which the stake is more resistant to being pulled over.

11. A method as in claim 9, wherein each stake includes at least two attachment points for the net; and wherein the attachment points are on a side of the stake toward which the stake is more resistant to being pulled over.

12. A method as in claim 9, wherein each stake includes at least two attachment points for the net.

13. A method as in claim 12, wherein the attachment points are snap hooks, hook material, or loop material.

14. A method as in claim 9, wherein the net is made of plastic or canvas netting.

15. A method as in claim 14, wherein when attached between the two stakes, a bottom of the net is no more than three inches above the ground.

16. A method as in claim 14, wherein the net is two feet high by sixteen to seventeen feet wide.

* * * * *